United States Patent [19]

Lawrence

[11] 4,114,328

[45] Sep. 19, 1978

[54] PREFABRICATED TRANSPORTABLE BUILDING WITHOUT CONTINUOUS STEEL CHASSIS

[76] Inventor: Robert Raymond Lawrence, 205 W. Fifth St., Alturas, Calif. 96101

[21] Appl. No.: 722,882

[22] Filed: Sep. 13, 1976

[51] Int. Cl.[2] ..... E04B 1/343

[52] U.S. Cl. ..... 52/79.1; 52/143

[58] Field of Search ..... 52/79.7, 79.8, 79.1, 52/143, 90, 92

[56] References Cited

U.S. PATENT DOCUMENTS

| | | | |
|---|---|---|---|
| 2,287,229 | 6/1942 | Carpenter | 52/79.8 X |
| 2,295,834 | 9/1942 | Drew | 52/712 X |
| 2,363,259 | 11/1944 | Penton | 52/79.8 |
| 2,706,313 | 4/1955 | Radman | 52/79.8 X |
| 2,990,588 | 7/1961 | McKinley | 52/143 |
| 3,697,098 | 10/1972 | Fisher | 52/143 |
| 3,765,714 | 10/1972 | Lau | 52/143 X |
| 3,791,082 | 2/1974 | Bowling | 52/90 X |

FOREIGN PATENT DOCUMENTS

| | | | |
|---|---|---|---|
| 148,469 | 10/1952 | Australia | 52/79 |

*Primary Examiner*—Alfred C. Perham

[57] ABSTRACT

A prefabricated building utilizing customary wood frame or other light construction is fabricated without a continuous steel chassis and after installation of a "Removable Low Level Building Carrier" now U.S. Pat. No. 4,065,892 and "Towing 'A' Frame Structure For Prefabricated Building", now U.S. Pat. No. 4,067,158, may be safely transported to final erection site. Accomplishment of the latter requires special care in floor plan selection, care in location of doors and windows, imposes a limit upon permissible overall building length for a given low level building carrier and requires special structural development of usual elements found in conventional prefabricated buildings e.g. exterior walls, ridge beam, rim joist and marriage wall.

5 Claims, 8 Drawing Figures

PREFABRICATED TRANSPORTABLE BUILDING WITHOUT CONTINUOUS STEEL CHASSIS

Prior to this invention, the major categories of transportable prefabricated buildings were mobile homes and modular buildings. Mobile homes were fabricated with a continuous steel chassis which incorporated wheeled running gear and a towing "A" frame. This chassis was quite elaborate and was designed exclusively for the "over the road" phase of the builidngs' economic life. This continuous steel chassis, even when it was acknowledged that there would be no further relocation of the building, was never salvaged from beneath the building primarily because of the difficulty, of physical and sometimes legal types, that would be encountered. These typical mobile homes usually had all of the necessary resisting elements which are required for "chassis-less" over the road transport as are specified under this invention but the floor plan was improper, exterior side walls weakened by door and window opening, i.e. in general the required resisting elements were not adequately structurally developed and interconnected. Although the ridge beam is always supported at each end wall of the double wide prefabricated building, intermediate vertical support, under current practice, is handled by two different methods. Method (1) where the half building is transported with an open face at the marriage line and thus there is no intermediate support provided directly under the ridge beam during transport but instead roof trusses which cantilever from an interior wall, usually a hall wall, support the ridge beam. Upon final erection, separately shipped columns are placed under the ridge beam to support it when subjected to "on site" dead and live roof loading. Method (2) where the half building is transported with a marriage line wall which lies along the marriage line of the half builiding and this marriage wall is directly beneath the ridge beam and provides support for same. Method (2) is used under this invention, but further, in the original floor plan selection, a floor plan is selected which will place this marriage wall, in fore-aft direction, so it lies directly or nearly directly above the "stiffened bed" which is provided by the low level building carrier. Similarly, heretofore modular buildings have contained at least the essence of necessary resisting elements to permit transport without use of a heavy flat bed trailer or the equivalent as with present practice, but again, these resisting elements were not properly structurally developed for transport by means of the low level building carrier and towing "A" frame of attending patent applications. On the matter of floor plan selection, categorically, the prefabricated building industry has heretofore reserved the freedom of adopting any one of a large number of floor plan arrangements to the given floor area. This was done at the expense of the resisting elements of this invention but since there was no reliance placed upon them for chassis-less transport no functional problem resulted-only lack of economy of materials. This invention specifies the principles to be followed in selection of a floor plan and arrangement of structural resisting elements with a final purpose of eliminating the customary steel chassis.

For the purpose of illustrating the invention there is shown in the drawings a form which is presently preferred; it being understood, however, that this invention is not limited to the precise arrangements and instrumentalities shown.

FIG. 1 is a side elevation view taken from either side of a single wide prefabricated building or from the exterior side wall side of a double wide prefabricated building FIG. 2 is a side elevation view taken from the marriage wall side of a double wide prefabricated building FIG. 3 is a front elevation view of one half of a double wide prefabricated building FIG. 4 is a front elevation view of two halves of a double wide prefabricated building FIG. 5 is a front elevation view of a single wide prefabricated building FIG. 6 is a fragmentary sectional elevation taken along line 2—2 of FIG. 1, showing the utilization of exterior siding that is substantially shear resistive FIG. 7 is a fragmentary sectional elevation taken along line 2—2 of FIG. 1, showing the utilization of exterior siding that is not substantially shear resistive FIG. 8 is a fragmentary sectional elevation taken along line 3—3 of FIG. 3

DETAILED DESCRIPTION

Figure 1:
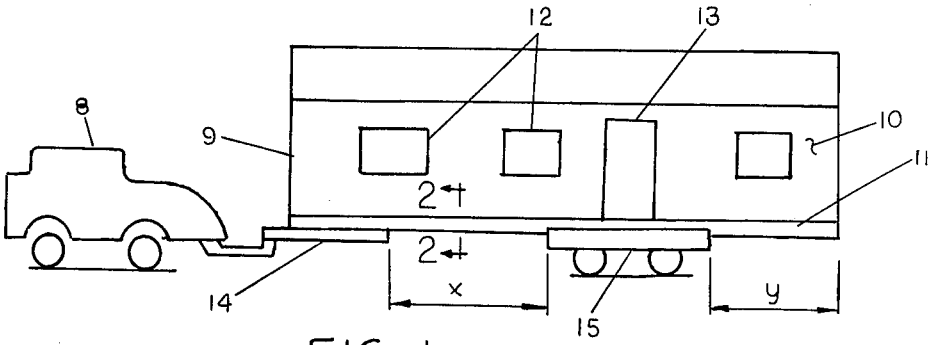
Figure 6:
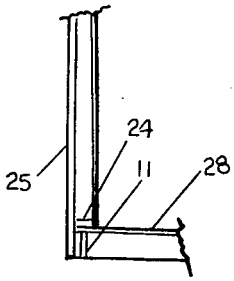
Figure 2:
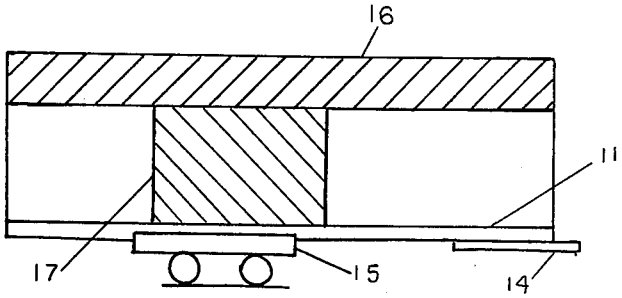
Figure 7:
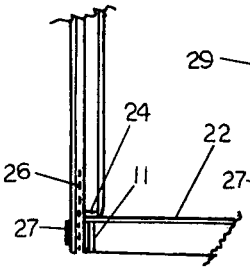
Figure 8:
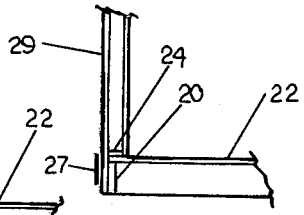
Figure 5:
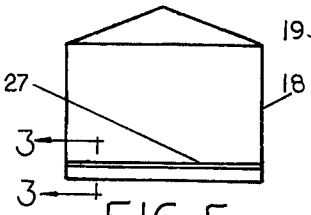
Figure 3:
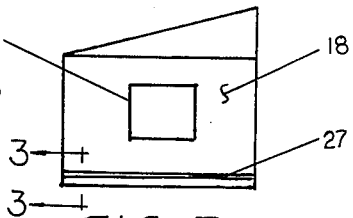
Figure 4:
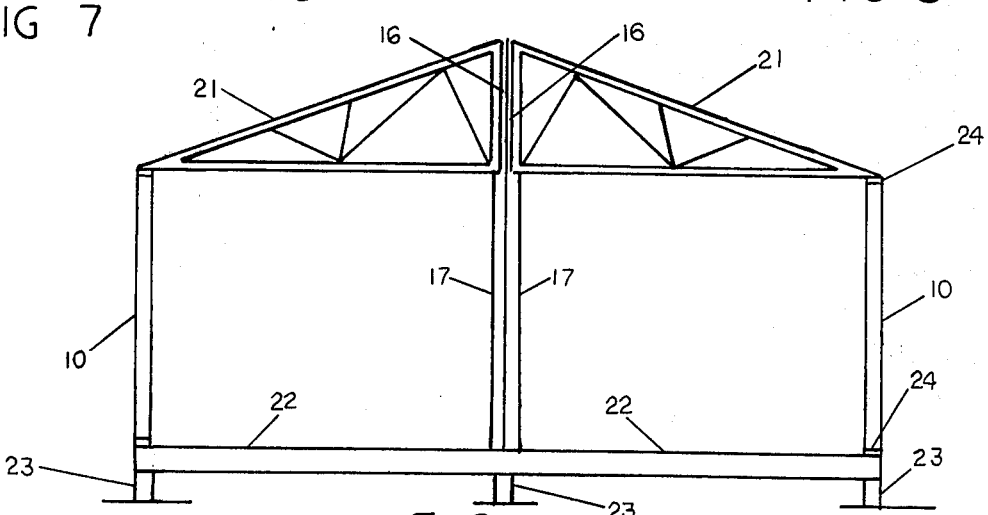

Referring to the drawings, a preferred embodiment of this invention is illustrated which, in general, includes load resisting elements that provide a structural "box" which is structurally adequate to resist "over the road" transport without need for the customary continuous steel chassis. Elements of the prefabricated building are described as follows. Towing vehicle 8 by attaching to towing "A" frame 14 pulls prefabricated building 9 which may be either a half building which along with another half building provides a double wide completed building or it may be a single width prefabricated building which is complete within itself. The double wide half buildings are joined upon being finally erected by placing their respective ridge beams 16 flat against one another whereupon connection is made to interconnect respective roof trusses 21, floors 22 and marriage walls 17. Buildings in their joined configuration are supported by foundation 23 and in this final erected phase are subjected to normal forces such as roof dead and live load, floor dead and live load and wind and earthquake loading which forces are resisted in a manner customary to conventional buildings and are therefore incidental to this invention. Methods of development of over the road load resisting elements are the invention herein and are treated separately as follows. (1) Side Wall As Girder. Single wide prefabricated buildings have two usable side walls 10 available while the double wide prefabricated building has only one side wall 10 available and therefore must couple the side wall resisting element with the ridge beam 16 resisting element. Side wall 10 can be developed as a deep girder of adequate strength by constructing it of normally utilized materials such as wood or steel studs for construction of the frame and covering the frame on at least one side with a material which is substantially shear resistive such as plywood siding or interior plywood paneling. As for bending strength, the depth-span ratio of the side wall girder is so favorable that the girder flange stress is relatively low and girder flanges comprising normally used top and bottom plates 24 are quite adequate particularly if plate splices are avoided in regions of high bending stress or are adequately reinforced by glued and stapled or nailed scabs, for example. Openings 12 and 13 in the side wall present a problem in that they weaken the girder, however, by placing door openings 13 over low level building carrier 15, which forms a stiffened 'bed' in its immediate area, the girder is not weakened since it is not under a condition of flexural stress. Windows 12, if limited to moderate size and particularly if placed in regions of low shear stress will not unduly weaken the side wall as a deep girder. The effective clear span of the side wall as a girder can be optimized in the case of simple span $x$ and cantilever span $y$ by acknowledgement of the two rigid support "zones" e.g. low level building carrier 15 and towing "A" frame 14 and by adjusting the force-aft location of building carrier 15 accordingly. The final variable to limit bending stress in the side wall as a girder is the establishment of overall length of the prefabricated building such that over stress will not result. In other words, increasing length beyond a certain size may require adding another axle to the low level builiding carrier. When exterior siding of substantial shear resistivity is used in construction of the side wall connection of side wall to floor is accomplished by lapping siding 25 over rim joist 11 and thus facilitating easy connection by nails, staples or screws with or without glue, for example for wood frame construction. When interior paneling or equivalent is used as the primary shear resisting element for the side wall girder, side wall-floor connection may be accomplished by steel straps 26 or equivalent. (2) Ridge Beam As Girder. Ridge beam 16 may be as open web truss or solid web girder but regardless of its form, it has a primary purpose of supporting one half the reaction load of roof trusses that are attached to it and it is designed to support roof dead and live loads which are of considerable magnitude. Of course the ridge beam will occur only in the double wide prefabricated building and when the two half buildings are erected the respective ridge beams will be flat against each other for the entire length of the building carrying the roof and ceiling load that is tributary to the ridge line of the building over spans that often exceed 20 feet in the case of mobile homes, for example. The ridge beam has the same clear span whether it carries customary building code imposed roof and ceiling loads or "over the road" loads and, interestingly, even the magnitude of the uniform distributed loads are comparable e.g. roof and ceiling dead and live loads vs. over the road loads, provided an impact allowance load factor is envisioned in addition to dead weight for over the road loading. The ridge beam, of course, has a sole function of operating as a deep girder and this capability is as readily available for over the road stress resistance as for ordinary roof and ceiling load resistance. The only weakening openings to be dealt with are air duct and attic access openings which may be located over the marriage wall thus avoiding structural weakening within the span of the ridge beam. As for structural attachment of ridge beam 16 to marriage wall 17 and end walls 18, this may be readily accomplished by steel straps 26. Attachment of steel strap 26 may vary from use of pneumatically driven staples driven through a light guage steel strap, for example, to a heavier strap connected with wood screws, depending upon load magnitudes. The ridge beam because of its inherent strength and stiffness as well as its easy connectability makes it an ideal resisting element for carrying its contributary share of over the road load. (3) End Wall As Girder. Over the road loads tributary to the end wall are vertical directed load reactions from towing "A" frame 14 and are effectively resisted by the transverse girder formed by front wall 18. End wall 18 is weakened by window opening 19 so the effective girder depth is limited to the distance from the window sill to the bottom of floor trusses or floor joist. Weakening openings in front end wall require covering area below opening with shear resistive siding or underlayment (beneath siding) 29 which connects to a replacement for the normal floor truss or joist occurring at front wall e.g. attachment member 20 which comprises two inch nominal wood or plywood and attachment is made with glue and staples or the equivalent. Load transfer from steel "A" frame 14 is made to attachment member 20 by steel load distributing front member 27 which is part of "A" frame 14 and which is connected to attachment member 20 by a multitude of lag bolts or bolts. (4) Rim Joist. The rim joist is a continuous wood member positioned at each extremity of the floor parallel to the longitudinal axis of the building to which all transverse floor joist or trusses are connected. Rim joist 11 provides the following functions: (a) Transmits uniformly distributed floor load resulting from reactions of floor joist or trusses, into foundation piers 23 between which piers it spans. (b) Provides support for edge of floor sheathing. (c) Provides flexural support for the floor structure, as a prefabricated item, before stiffening walls are attached so that the floor structure may be handled by cranes, etc. (d) Combines with the lower plate of the side wall, being attached securely thereto by shear resistive siding, to also act as lower flange of side wall as girder. (e) Provides a member to which load distributing side plates of both towing "A" frame 14 and low level building carrier 15 connect. Rim joist 11 comprises two thicknesses of plywood or solid lumber having a width equal to the thickness of the building floor. These pieces are glued and stapled together over the entire length of the rim joist 11 so that its strength is not weakened by end splices which can be accomplished by reinforcing end splices with scab blocks glued and stapled between floor joist where end splices occur. (5) Marriage Wall. A marriage wall is to be contrasted to a wall lying on the marriage line which latter wall occurs only on one building half and stands alone in the erected building. The marriage wall, on the other hand, occurs on each building half and the two marriage walls are placed flat against one another in the final erection. Marriage wall 17 lies directly below ridge beam 16 and serves primary purpose of providing structural support for the ridge beam. In normal prefabricated building construction the fore-aft location of marriage wall relative to running gear is relatively unimportant because end reactions of the ridge beam are transmitted to the ground by piers properly located when the building is erected. Under this invention the marriage wall 17 must be carefully located, fore-aft, to lie directly above the low level building carrier 14. Marriage wall 17 has the effect of projecting the "stiffened bed" provided by the low level building carrier 14 upward to provide rigid continuous support for ridge beam 16 and this is an important provision for attaining over the road stiffness for the prefabricated building. Marriage wall 17 is constructed of substantially shear resistive material placed over conventional studs and is connected to ridge beam web and rim joist, respectively, with nails or screws with or without glue, or the equivalent.

Although a preferred embodiment of this invention has been shown and described, this invention is not meant to be limited thereto but is intended to embody all forms and modifications within the spirit of the following claims.

I claim:

1. A prefabricated building comprising an elongated horizontally disposed planar floor structure and vertical exterior walls extending above said floor a predetermined distance to support a roof structure said roof structure comprising a multitude of parallel roof trusses forming an inclined plane with their top chords and a horizontal plane with their bottom chords, said floor structure comprising a multitude of parallel floor joist or floor trusses covered on their top edges with floor decking said floor structure having a vertical thickness substantially equal to the depth of said floor trusses or floor joist, further comprising, a. at least one exterior side wall lying parallel to the longitudinal axis of said prefabricated building comprising, a frame composed of a multitude of vertical elongated studs parallel to each other and lying in a vertical plane said studs connecting to a top plate at their upper ends and to a bottom plate at their lower ends, sheathing comprising substantially shear resistive material attached to a side of said frame, means for resisting loads when transporting said prefabricated building, which is devoid of presently customary continuous steel chassis, over the road without over stress of said side wall said means being generally by providing said side wall as a deep girder in a simple span between a building carrier position between afront and rear of said building and a towing "A" frame toward the front of said building and a cantilever span between said building carrier and the rear extremity of said building, said building carrier being positioned in a fore-aft direction to prevent over stress of said side wall functioning as a deep girder when supporting contributary over the road loading of said side wall and including increasing the length of the building carrier in a fore-aft direction and adjusting its location in a fore-aft direction until neither cantilever span nor simple support spans induce over stress in said side wall girder, door means positioned in said said wall so that side wall will act as a girder when supporting over the road loading of said side wall and is not structurally weakened, said door means being positioned directly over or as near to directly over, said low level building carrier as practicable, window means provided in said side wall so that side wall acting as girder when supporting over the road loading is not structurally weakened, said window means being provided by reinforcing and/or minimizing size of said opening as necessary and locating said openings in regions of low shear stress of said side wall functioning as a girder, said sheathing of said side wall being connected to a rim joist said sheathing being substantially shear resistive, b. an exterior front end wall of said building said end wall lying perpendicular to the longitudinal axis of said building, comprising, a frame composed of a multitude of vertical elongated studs parallel to each other and lying in a vertical plane said studs connecting to a top plate at their upper ends and to a bottom plate at their lower ends, exterior sheathing comprising substantially shear resistive material attached to the exterior side of said frame, end wall reinforcing means reinforcing said end wall to resist load reactions produced by said towing "A" frame said means being generally by providing said end wall as a deep girder in a span between side extremities of said building, window means provided in said end wall said window means being provided by developing portion of said wall below window sill and above bottom extremity of said floor structure as a girder by lapping said shear stress resistive exterior sheathing over a front attachment member which underlies the front wall and attaching thereto by adhesive and/or mechanical fasteners such as staples, nails or screws, said end wall reinforcing means including transferring concentrated load reactions of towing "A" frame into said end wall without overstress said reinforcing means including a steel load distributing member which is a part of said towing "A" frame and bolting or lag screwing said steel load distributing member to said shear resistive sheathing and to said front attachment member underlying said front end wall, said front attachment member being minimum two inch nominal wood or plywood and, in effect, substituting for the individual floor truss or floor joist occurring at this point, c. said rim joist comprising two longitudinally elongated rim joist members to which said floor trusses or floor joist are connected, lying in a vertical plane and parallel to each other at either side extremity of said floor structure comprising wood or plywood pieces joined and spliced together by staples and adhesive or the equivalent in such a manner that no weakening or cross section results at splices, said splices being individually reinforced by scabs placed between floor trusses or floor joist and attached by means of adhesive and staples or the equivalent, said rim joinst being connected to said floor trusses or floor joist by mechanical fasteners such as screws, staples or nails extending through said rim joist and into end post of floor trusses or into end grain of floor joist, said rim joist members being connected to said steel load distributing members which are a part of said building carrier and said towing "A" frame, respectively, by placing portions of said steel load distributing members flat against said rim joist and connecting thereto with mechanical fasteners such as lag bolts or bolts, d. a ridge beam lying in a vertical plane and vertically above the marriage line of said building, having a length substantially equal to the length of said building and a width substantially equal to the height of said roof trusses and being attached thereto, comprising either an open web truss type or a solid web girder type, ridge beam reinforcing means resisting loads when transporting said prefabricated building, which is devoid of presently customary continuous steel chassis, over the road without over stress of said ridge beam, said ridge beam reinforcing means being generally by providing said ridge beam as a girder in a cantilever span between a marriage wall rear extremity and rear extremity of said prefabricated building and in simple span between a front extremity of said marriage wall and said towing "A" frame, said ridge beam being supported by said end walls at each end of said ridge beam and said marriage wall lying between said end walls and directly under said ridge beam, said building carrier being positioned to prevent over stress of said ridge beam when supporting contributary over the road loading of said ridge beam and including increasing the length of said building carrier in fore-aft direction and by positioning said low level building carrier in fore-aft direction such that neither cantilever span nor simple support span of said ridge beam produce over stress of said ridge beam, said ridge beam being connected to said end walls and said marriage wall, said means being by providing steel straps placed flat against said ridge beam and said walls and attaching said straps with mechanical fasteners such as staples, nails or screws, e. said marriage wall lying parallel to the longitudinal axis of said prefabricated building comprising, a frame composed of a multitude of vertical elongated studs lying parallel to each other and in a vertical plane, said studs connecting to a top plate at their upper ends and to a bottom plate at their lower end, exterior sheathing comprising substantially shear resistive material attached to exterior side of said studs, said marriage wall being positioned to support said ridge beam and being placed directly over, or as nearly so as practicable, said low level building carrier.

2. The structure as in claim 1 where the sheathing lies on the exterior of the building and being lapped over said rim joist and connected thereto by fastener means.

3. The structure as in claim 1 where the sheathing lies on the interior of said building and provides a shear resisting element in said side wall girder, said rim joist connection being provided by placing one end of a steel strap over the rim joist and the other end of said strap over the exterior side of said wall stud and fastening each end with mechanical fasteners.

4. The structure as in claim 1 wherein said exterior sheathing of said front end wall comprises an underlayment which is substantially shear resistive which is placed under an exterior layer which is not substantially shear resistive.

5. A prefabricated building comprising an elongated horizontally disposed planar floor structure and vertical exterior walls extending above said floor a predetermined distance to support a roof structure said roof structure comprising a multitude of parallel roof trusses forming an inclined plane with their top chords and a horizontal plane with their bottom chords, said floor structure comprising a multitude of parallel floor joinst or floor trusses covered on their top edges with floor decking said floor structure having a vertical thickness substantially equal to the depth of said floor trusses or floor joist, further comprising, a. two exterior side walls lying parallel to the longitudinal axis of said prefabricated building comprising, a frame composed of a multitude of vertical elongated studs parallel to each other and lying in a vertical plane said studs connecting to a top plate at their upper ends and to a bottom plate at their lower ends, sheathing comprising substantially shear resistive material attached to each exterior side wall, means for resisting loads when transporting said prefabricated building, which is devoid of presently customary continuous steel chassis, over the road without over stress of said side walls said means being generally by providing said side walls as deep girders in simple spans between a building carrier positioned between afront and rear of said building and a towing "A" frame toward the front of said building and cantilever spans between said building carrier and the rear extremity of said building, said building carrier being positioned in a fore-aft direction to prevent over stress of either side wall functioning as a deep girder when supporting contributary over the raod loading of said side walls and including increasing the length of the building carrier in a fore-aft direction and adjusting its location in a fore-aft direction until neither cantilever spans nor simple support spans induce over stress in said side wall girders, door means positioned in said side walls so that side walls will act as girders when supporting over the road loading of said side walls and are not structurally weakened, said door means being positioned directly over or as near to directly over, said low level building carrier as practicable, window means provided in said side walls so that side walls acting as girders when supporting over the road loading are not structurally weakened, said window means being provided by reinforcing and/or minimizing size of said openings as necessary and locating said openings in regions of low shear stress of said side walls functioning as girders, said sheathing of said side walls being connected to each rim joist said sheathing being substantially shear resistive, b. an exterior front end wall of said building said end wall lying perpendicular to the longitudinal axis of said building, comprising, a frame composed of a multitude of vertical elongated studs parallel to each other and lying in a vertical plane said studs connecting to a top plate at their upper ends and to a bottom plate at their lower ends, exterior sheathing comprising substantially shear resistive material attached to the exterior side of said frame, end wall reinforcing means reinforcing said end wall to resist load reactions produced by said towing "A" frame said means being generally by providing said end wall as a deep girder in a span between side extremities of said building, window means provided in said end wall said window means being provided by developing portion of said wall below window sill and above bottom extremity of said floor structure as a girder by lapping said shear stress resistive exterior sheathing over a front attachment member which underlies the front wall and attaching thereto by adhesive and/or mechanical fasteners such as staples, nails or screws, said end wall reinforcing means including transferring concentrated load reactions of towing "A" frame into said end wall without over stress said reinforcing means including a steel load distributing member which is a part of said towing "A" frame and bolting or lag screwing said steel load distributing member to said shear resistive sheathing and to said front attachment member underlying said front end wall, said front attachment member being minimum two inch nominal wood or plywood and, in effect, substituting for the individual floor truss or floor joist occurring at this point, c. said rim joist comprising the longitudinally elongated rim joist members to which said floor trusses or floor joist are connected, lying in a vertical plane and parallel to each other at either side extremity of said floor structure comprising wood or plywood pieces joined and spliced together by staples and adhesive or the equivalent in such a manner that no weakening of cross section results at splices, said splices being individually reinforced by scabs placed between floor trusses or floor joist and attached by means of adhesive and staples or the equivalent, said rim joist being connected to said floor trusses or floor joist by mechanical fasteners such as screws, staples or nails extending through said rim joist and into end post of floor trusses or into end grain of floor joist, said rim joist members being connected to said steel load distributing members which are a part of said building carrier and said towing "A" frame, respectively, by placing portions of said steel load distributing members flat against said rim joist and connecting thereto with mechanical fasteners such as lag bolts or bolts.

* * * * *